US007486087B2

(12) United States Patent
Duss

(10) Patent No.: US 7,486,087 B2
(45) Date of Patent: Feb. 3, 2009

(54) METHOD FOR MEASURING THICKNESS OF PRINT PRODUCTS PASSING SPACED APART AT SPECIFIC DISTANCES IN A CONVEYING FLOW THROUGH A MEASURING DEVICE

(75) Inventor: Hanspeter Duss, Däniken (CH)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 11/228,321

(22) Filed: Sep. 19, 2005

(65) Prior Publication Data

US 2006/0061370 A1 Mar. 23, 2006

(30) Foreign Application Priority Data

Sep. 20, 2004 (EP) ..... 04405601

(51) Int. Cl.
*G01R 27/26* (2006.01)
*G01B 7/02* (2006.01)

(52) U.S. Cl. ..... 324/671; 324/662; 702/170

(58) Field of Classification Search ..... 324/662
See application file for complete search history.

(56) References Cited

U.S. PATENT DOCUMENTS 3,764,899 A * 10/1973 Peterson et al. ..... 324/671
4,836,528 A * 6/1989 Geiser ..... 271/263
5,291,791 A * 3/1994 Lucas et al. ..... 73/861.08
5,712,804 A 1/1998 Elbling
6,388,452 B1 * 5/2002 Picciotto ..... 324/663
6,420,882 B1 * 7/2002 Engebretsen et al. ..... 324/667
6,472,887 B1 * 10/2002 Tullis et al. ..... 324/663

FOREIGN PATENT DOCUMENTS

| | | | |
|---|---|---|---|
| CH | 671 754 | A5 | 9/1989 |
| DE | 37 19 972 | A1 | 1/1988 |
| DE | 195 49 351 | A1 | 4/1997 |
| DE | 198 57 977 | A1 | 9/1999 |

OTHER PUBLICATIONS

Biller U., Kein Blatt Zuviel, Technische Rundschau, Hallwag Verlag., May 24, 1996, pp. 42-43, vol. 88, No. 21, Bern, Switzerland.

* cited by examiner

*Primary Examiner*—Vincent Q Nguyen
*Assistant Examiner*—Jeff Natalini
(74) *Attorney, Agent, or Firm*—Venable LLP; Robert Kinberg; Steven J. Schwarz

(57) ABSTRACT

A device for measuring the thickness of print products in a conveying flow includes a plate capacitor having a first plate and a second plate located on opposite sides of the print products. The plate capacitor is adapted to measure capacitance of the print products passing between the first plate and the second plate. A LC oscillator circuit is attached to the plate capacitor.

6 Claims, 3 Drawing Sheets

METHOD FOR MEASURING THICKNESS OF PRINT PRODUCTS PASSING SPACED APART AT SPECIFIC DISTANCES IN A CONVEYING FLOW THROUGH A MEASURING DEVICE

CROSS-REFERENCE TO RELATED APPLICATIONS

This application claims the priority of European Patent Application No. 04405601.8, filed on Sep. 20, 2004, the entire content of which is incorporated herein by reference.

BACKGROUND OF THE INVENTION

1. Technical Field of the Invention

The invention relates generally to a method for measuring the thickness of print products, and more particularly, to a method for measuring the thickness of print products flowing through a measuring device in spaced intervals.

2. Related Art

Conveying systems that operate on a timed cycle commonly include a rotating drum having grippers that grip print products to be separated, and transfer the print products to one or more conveying belts. The thickness of the print products can be measured on the rotating drum or on the downstream conveying device (e.g. between belts). Known systems detect the product thickness, for example, by mechanical means, for example, by scanning the thickness of the product and measuring the deflection thereof. Swiss Patent No. 671 754 discloses one known device for measuring the thickness of print products on a rotating drum with grippers.

Known measuring systems have various disadvantages. For example, taking the measurement on a rotating drum having grippers only makes sense if the withdrawing device also utilizes grippers. Also, scanning with rollers can be mechanically involved, in particular, in cases where the cycle rate is high, thicknesses vary greatly, or markings must be prevented.

Some non-contacting systems for measuring the thickness of print products are also known. Known non-contacting systems typically measure the degree of light absorption and/or ultrasound absorption by the print product and use the obtained value as a measure for the thickness of the print product. These methods, however, can only be used with extremely thin products.

Other known arrangements measure the thickness of paper during winding and/or unwinding of paper rolls, or measure the thickness of labels on a backing strip by measuring capacitance. Features of these measuring arrangements are based on bridge circuits where the measured capacitance is electronically compared to a reference capacitance.

This type of measurement uses an analog signal, the magnitude of which reflects the measured capacitance value. Usually, the reference capacity must be equalized manually.

Solutions of this type have the disadvantage that in most cases individual equalization of the device is required. Another disadvantage is that the analog signal which represents the capacitance is subject to interference, so that involved configurations are often necessary.

Therefore, there remains a need in the art for a measuring device for print products flowing through the measuring device in spaced intervals, that overcomes the shortcomings of conventional solutions.

SUMMARY OF THE INVENTION

It is an object of the present invention to provide a measuring device that is capable of measuring the thickness of print products in a conveying flow, wherein the thicknesses cover a wide range, and wherein the measuring device substantially prevents undesirable markings on the print products. It is a further object of the present invention to provide such a measuring device that is no more expensive than existing thickness measuring devices.

This object is solved according to the present invention by determining the print product thickness by measuring the capacitance of the print products in a plate capacitor.

According to one exemplary embodiment, the present invention relates to a method of measuring the thickness of print products, comprising: passing the print products in a conveying flow through a measuring device comprising a plate capacitor; measuring the capacitance of the print products using the plate capacitor; and determining the thickness of the print products based on the capacitance.

According to another exemplary embodiment, the present invention relates to a device for measuring the thickness of print products in a conveying flow, comprising: a plate capacitor having a first plate and a second plate located on opposite sides of the print products, the plate capacitor adapted to measure capacitance of the print products passing between the first plate and the second plate; and a LC oscillator circuit attached to the plate capacitor.

Further objectives and advantages, as well as the structure and function of preferred embodiments, will become apparent from a consideration of the description, drawings, and examples.

BRIEF DESCRIPTION OF THE DRAWINGS

These and other features and advantages of the invention will be further understood from the following detailed description of the preferred embodiments with reference to the accompanying drawings, in which.

DETAILED DESCRIPTION OF THE PREFERRED EMBODIMENTS

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Figure 1:
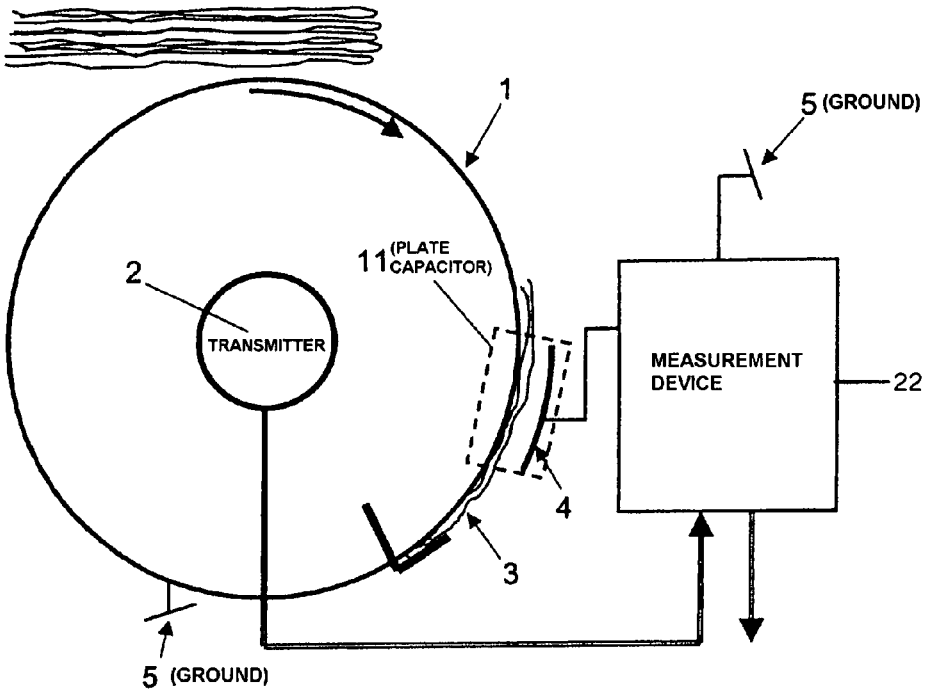
FIG. 1 is a schematic representation of an exemplary measuring device for practicing the method of the present invention.

Referring to FIG. 1, an exemplary apparatus for carrying out the method of the present invention is shown. As shown in FIG. 1, the apparatus can take the form of a feeder comprising a conveying drum 1 for separating print products 3, although other configurations are possible. The method and apparatus make use of the effect that a plate capacitor 11 increases its capacitance if a material, such as paper, is placed between its plates 1, 4. The plate capacitor 11 can comprise an active electrode 4 and the conveying drum 1 connected to ground 5.

A measurement device 22, comprising a plurality of electronic components, determines the sheet thickness based on the measured capacitance.

Figure 2:
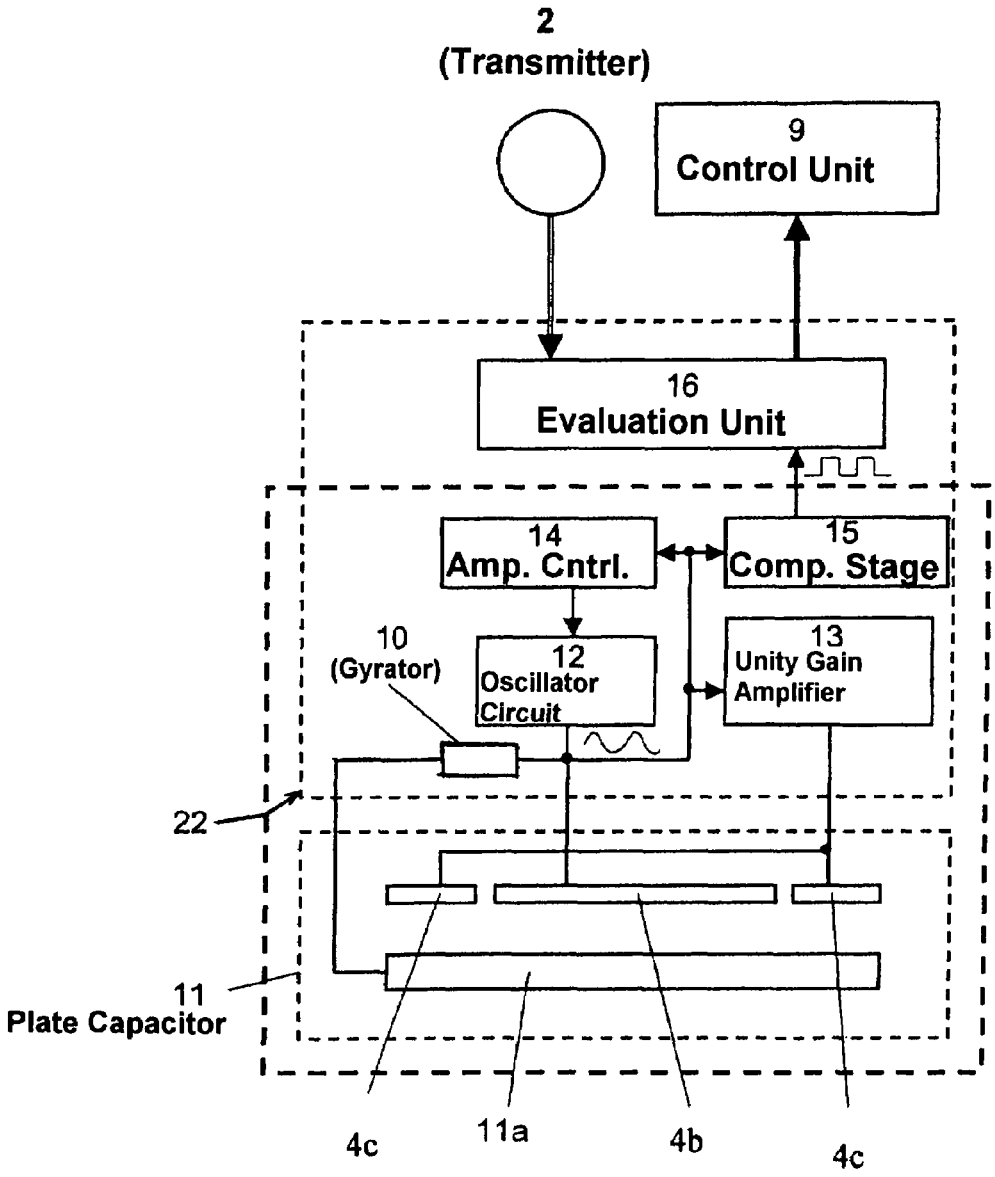
FIG. 2 is a circuit diagram for an exemplary measuring device for practicing the method of the present invention.

Referring to FIG. 2, the method of measuring the capacitance according to the present invention can be based on the principle that the plate capacitor 11 (corresponding to plates 1 and 4 in FIG. 1) is connected in parallel with a device having high inductance, for example, a gyrator circuit 10. As a result, the oscillating frequency f of the LC oscillator can be fixed by the formula $f=1/(\sqrt{LC}\cdot 2\pi)$. An oscillator circuit 12 energizes the oscillations of the LC resonant circuit. With the aid of a unity-gain amplifier 13, a guarding ring 4*c* can be generated as part of the plate capacitor 11, so as to improve the characteristics of the measuring component 4*b* of the plate capacitor 11. The amplitude control 14 contributes to improving the stability of the oscillations. A comparator stage 15 converts the sine-shaped oscillations to a rectangular signal, which is then processed with the aid of an evaluation unit 16. The evaluation unit 16 receives position signals from an incremental transmitter 2, and transmits the results and/or the measured thickness values to a superposed control unit 9. Downstream-connected evaluation electronics may still be required to measure the oscillating frequency. However, these electronics are subject to considerably less interference than evaluation of an analog signal, which is required when using known bridge circuits with predetermined frequency and reference capacity.

A further advantage of the device of the present invention is that the oscillating frequency to be measured can be determined through averaging several time measurements of individual oscillation cycles, so that individual cycles that deviate excessively with respect to time and/or the preceding or subsequent cycles (i.e., outlier values), do not need to be considered for the evaluation. This filtering also allows short, strong interference pulses from the outside to briefly distort the oscillating frequency, but not to affect the average measuring value.

One reason for preferring a thickness measuring device that operates on a capacitive basis is that the thickness measurement can be made at any time. For example, the thickness can be measured in a specified position detected by an incremental transmitter 2, as well as several times during each processing cycle. This characteristic can be used to realize a new measurement for the print product thickness of 0 (the so-called "zero measurement"). The zero measurement 20 can be taken, for example, in a gap existing between two products. If the point in time for taking the zero measurement is also detected, then several successive zero measurements can be used to determine a time-dependent trend 18 for the effective zero measurement. As a result, any slow drift phenomena that occurs in the measuring system (caused, for example, by thermal changes in the electronic equipment, or by slow, mechanical deformations of the plate capacitor) can thus be compensated for.

Even if there are no gaps between the print products in the conveying flow, a trend for the zero measurement can still be computed by approximation. For example, all of the zero measurements can be made during a break in the conveying flow, or immediately beforehand. When the print products then follow in a continuous flow (even in an overlapping flow), the measured values for the product thicknesses, together with the point in time for the measurements, are stored, for example, in the evaluation unit 16. The trend line for the zero measurements can be obtained by subtracting a reference thickness from the measured thickness, using only measured values of print products that represent a correct thickness with sufficient certainty.

For product thickness measuring methods, it is known that during a first phase, sometimes referred to as the "reference phase," a reference thickness 21 can be determined by detecting one measuring value with a print product, and one without a print product. A reference value for the correct product thickness can be determined from these measured values. During a second phase, sometimes referred to as the "control phase," the measurements for additional print products of unknown thickness are compared to the reference values obtained in the reference phase. If the measured product thicknesses deviate from the reference values by more than a specified tolerance, and error signal can be transmitted to a superposed control.

Figure 3:
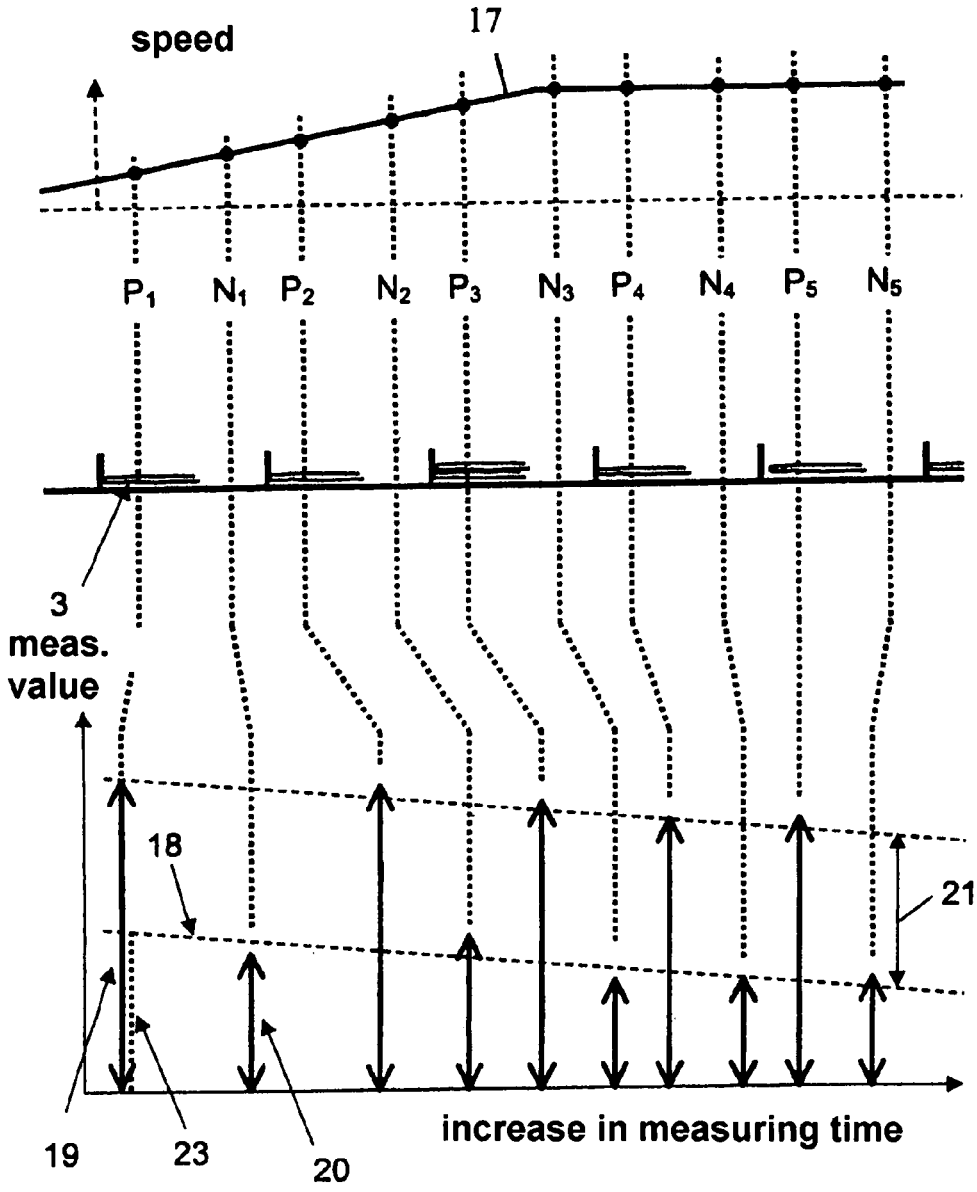
FIG. 3 is a diagram for computing the trend line for the time-dependent zero value of a conveying flow consisting of print products.

FIG. 3 shows a series of clocked conveyed print products 3. The non-constant speed is indicated with line 17. $P_1 \ldots P_5$ are points for measurements along the path of the print product through the plate capacitor. $N_1 \ldots N_5$ represent measurements made between the print products. The measured values are noted in the lower region of FIG. 3 with double arrows. One difficulty frequently encountered with prior art measuring systems is that they are subject to drift, in particular, that the zero measurement changes over time. The zero measurement $N_1 \ldots N_5$ often cannot be repeated with some known systems. The method according to the invention addresses this problem by continuously computing the system drift by calculating a trend line for the zero value. This can be done in two ways, described below.

If it is not possible to take a zero measurement during a processing cycle, a new zero measurement can be computed from the measurement $P_1 \ldots P_5$ of the print product thickness 19. Initially, as shown in FIG. 3, the zero value extrapolated from the trend line 18 and the reference value from the reference phase are compared to the measured value 19. If the two values are high by a similar amount, it leads to the conclusion that a printed product with correct thickness is present. In that case, the measured value 19 is again used to compute a new theoretical zero measurement 23 by subtracting the reference value from the measured value 19. The point in time for detecting the measured value 19 is also recorded and used together with the new theoretical zero value, and the previous zero measurements, to compute a trend for drift and/or a trend line 18 of the zero value. A new zero value can then be extrapolated from the trend line 18 for the next measuring cycle, and used for the following thickness measurement.

For conveying systems using timed-cycle processing (for example, having a gap between the products), the above-described method can be improved because the zero value can be measured directly (at the gap) and does not need to be derived from measuring the thickness of the print product. This makes it possible to obtain an even more reliable trend analysis for the zero value.

The device of the present invention allows the use of new methods for preventing outside interference, which could not be prevented with the known methods that operate based on measuring an analog current or voltage value. Presently used methods generally supply an integral measuring value over a period of several milliseconds. For that reason, the digital evaluation unit 16 contains a time-measuring device for measuring the duration of many successive oscillation periods with high accuracy and for storing these values. Outside interferences usually occur in the form of so-called "bursts" and can distort only a few of the detected oscillation cycles. These faulty measurements can be uncovered by means of a statistical analysis and can be omitted from further processing.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A device for measuring the thickness of print products in a conveying flow, comprising:

an LC oscillator circuit, comprising:

a plate capacitor having a first plate and a second plate located on opposite sides of the print products, the plate capacitor adapted to measure capacitance of the print products passing between the first plate and the second plate in the conveying flow; and an inductor connected in parallel with the plate capacitor;

an oscillator circuit connected to the LC oscillator circuit; and an evaluation unit connected to the LC oscillator circuit, the evaluation unit adapted to determine the thickness of the print products based on an oscillating frequency of the LC oscillator circuit.

2. The device of claim 1, wherein the inductor comprises a gyrator circuit connected in parallel with the plate capacitor.

3. The device of claim 1, further comprising a unity-gain amplifier adapted to generate an guarding ring at the plate capacitor.

4. The device of claim 1, further comprising a feeder adapted to convey the print products on a timed cycle, wherein the oscillating frequency of the LC oscillator circuit is synchronized with the timed cycle.

5. The device of claim 4, wherein the feeder comprises a conveying drum for separating the print products.

6. The device of claim 1, wherein the evaluation unit is adapted to determine the thickness of the print products based exclusively on the oscillating frequency of the LC oscillator circuit.

* * * * *